US007493676B2

(12) United States Patent
Murasaki et al.

(10) Patent No.: US 7,493,676 B2
(45) Date of Patent: Feb. 24, 2009

(54) HOOK FASTENER STRUCTURES

(75) Inventors: Ryuichi Murasaki, Macon, GA (US); Tsuyoshi Minato, Cheshire (GB)

(73) Assignee: YKK Corporation, Tokyo (JP)

( * ) Notice: Subject to any disclaimer, the term of this patent is extended or adjusted under 35 U.S.C. 154(b) by 308 days.

(21) Appl. No.: 11/403,532

(22) Filed: Apr. 13, 2006

(65) Prior Publication Data

US 2007/0240289 A1 Oct. 18, 2007

(51) Int. Cl.
*A44B 18/00* (2006.01)

(52) U.S. Cl. ..... 24/442; 428/100; 24/452

(58) Field of Classification Search ..... None
See application file for complete search history.

(56) References Cited

U.S. PATENT DOCUMENTS

| | | | | |
|---|---|---|---|---|
| 5,131,119 | A * | 7/1992 | Murasaki et al. | 24/452 |
| 5,339,499 | A | 8/1994 | Kennedy et al. | |
| 2005/0160534 | A1 | 7/2005 | Akeno et al. | |
| 2006/0200951 | A1 * | 9/2006 | Provost et al. | 24/452 |

OTHER PUBLICATIONS

General Motors Engineering Standard GM2743M entitled "Reclosable Fasteners" dated Dec. 1997, pp. 1-6.

* cited by examiner

*Primary Examiner*—Jack W. Lavinder
(74) *Attorney, Agent, or Firm*—Kilpatrick Stockton LLP

(57) ABSTRACT

Hook structures for use in hook and loop or hook and engagement material fastening applications. Structures according to embodiments of the invention include hooks which extend from bases which in turn extend from a foundation and also extend laterally across the structures. The bases are separated by valleys which also extend laterally across the structures, whose height can be uniform laterally in the structures or varied. The bases provide suitable strength and support to allow the hooks to be robust and strong for permanent or semi-permanent fastening applications, while the valleys interposed between bases allow the hooks to penetrate sufficiently deeply into the engagement material for effective fastening to occur. Such structures may be formed according to processes which physically or conceptually employ various layers to support hooks, retention barrier members such as fingers interposed laterally between hooks, and/or for spacing such hooks and barriers as desired. Accordingly, structures can be formed according to the present invention using conventional ring-molding techniques (or any other desired techniques), to provide hook fasteners with excellent fastening strength and other desired properties typically required, for example, in semi-permanent or permanent fastening applications.

31 Claims, 6 Drawing Sheets

HOOK FASTENER STRUCTURES

BACKGROUND

The present invention relates to fastener structures having hook elements which are adapted to engage with engaging material such as loop elements. Fasteners formed from such structures are useful in many applications and particularly applications which require permanent or semi-permanent fastening.

Hook and engagement material fasteners typically include hook elements that engage with a loop material or other engagement material. The hook structure of the fastener engages the engagement material to fasten the two items together, while also assuring release from the engagement material in a desired manner. Many hook fastener structures are made of cut monofilaments which can elongate during fastener separation to release the engagement material, so that they must feature excellent tensile and bending strength over repeated cycles of fastening and unfastening. Such fasteners are useful in apparel, for example, where fastening must be secure, release must be relatively trouble free and multiple cycles of fastening and washing can be expected over the life of a garment. Monofilament hooks can be spaced densely according to textile weave, thus causing very reliable fastening and durability in repeated use. However, these thin monofilament hooks can be expensive to manufacture, and are typically less suitable where great fastening strength (force per unit area of fastener required to separate the hook portion of the fastener from the engagement material), is required.

Other hook fastener structures are manufactured by being integrally molded using, for example, continuous or other injection molding. These hook portions are typically more rigid than the monofilament type hooks in order to increase fastening strength. However, such rigidity can cause failure over repeated cycles of fastening and release, so that such fasteners are typically better suited for semi-permanent or permanent applications where multiple releases are not required but fastening strength is required, such as installation of signage or automotive applications including installation of seat fabric, seat covers and other interior finish materials.

One challenge faced by manufacturers of hook and loop fastener material for semi-permanent applications is to develop a configuration that allows the hook structure to engage the engagement material with great fastening strength, but yet feature sufficient flexibility to permit sufficient temporary bending at the curved portion to allow engagement of the loop portion of the fastener to occur during fastening. One approach has been to include additional material in the stem of the hook portion, such as by adding lateral or other dimensional thickness, in order to impart additional strength to the stem, while allowing the curved portion of the hook which engages the loop to be thinner or of less material in order to bend and retain sufficient resilience to engage the loop material. The stiffer stems of such hooks can impart additional support and strength to the curved portions in order to give the fastener considerable fastening strength. Yet in such designs, the stem portions need to be sufficiently long to cause the curved portions to penetrate sufficiently deeply into the loop material to achieve proper semi-permanent or permanent, strong engagement with the hook portion.

One example of a conventional design is described in U.S. Pat. No. 5,131,119, which is incorporated by reference. That patent discloses rows of hooks that feature reinforcing ribs that extend partially the length of the stem. A drawing of such a design from that patent constitutes FIG. 4 herein. Another example is described in U.S. Pat. No. 5,339,499, which is also incorporated by reference, and which discloses hooks with stems that feature a substantially greater lateral thickness than the crook portions. Drawings from that Patent which constitute FIGS. 5A, 5B and 5C herein show such a stem with such a greater thickness. U.S. Ser. No. 11/043,339 filed Jan. 26, 2005 in the name of Akeno, et. al, published as U.S Pub. No. 2005/0160534 A1 on Jul. 28, 1995, which is also incorporated herein by reference, discloses molded hook fastener structures with hooks that have lateral reinforcement, and continuous manufacturing processes for making them.

SUMMARY

Embodiments of the present invention can provide hook fastener structures with hook elements that are adapted to perform effectively in semi-permanent or permanent applications such as automotive seat cover installations, where fastening may occur only once, but fastening strength needs to be great in order to approach, for instance, a level of strength provided by stitching or other conventional non-hook and loop fastening. The hooks project from bases instead of directly from the foundation layer of the structure, in order among other things to impart additional strength and robustness to the stems of the hooks so that the crooks can perform more effectively in capturing or engaging the engaged element (such as loop fastener material). The bases are separated longitudinally in the structure by valleys, which can extend laterally across the structure and which can allow the hooks to project further into the engaged material for deeper penetration and stronger fastening.

Embodiments of the invention can be formed using conventional ring mold techniques, in which successive rings are fabricated to produce successive lateral layers of the structure. For example, a preferred structure according to the invention can feature: (1) a number of hook layers in which hooks extend from bases separated by valleys; (2) a number of retention layers in which fingers extend from bases separated by valleys, the fingers positioned between hooks laterally across rows of hooks in some but preferably not all hook rows; and (3) a number of spacer layers, which may be interposed between hook layers and retention layers, and which may feature no structure extending from the bases. Either or both the retention layers and spacer layers may be omitted, and any of the layers can be adjusted in height, shape, width or any other desirable dimension or manner to optimize the fastening strength and other properties of the structure for particular semi permanent or permanent applications, such as where the fastener which employs the structure is required to have great fastening strength, but only needs to be released a limited number of times.

It is accordingly an object of the invention to provide hook fastener structures for use in semi-permanent or permanent applications such as automobile seat cover installations, signage, and other applications, where the hooks of the structure feature improved robustness and fastening strength imparted by projecting from bases which in turn project from lower in the structure such as a foundation layer, rather than extending directly from the foundation layer as in previous designs.

It is an additional object of the present invention to provide hook fastener structures which can be formed conceptually or physically of a number of layers, for manufacture using conventional ring mold techniques or other desired techniques, thereby allowing ready modification of various features of the structures, such as shape and dimensions of hooks and their components as well as the bases from which they project, to optimize performance for particular uses and applications.

Other objects, features and advantages will become apparent with reference to the remainder of this document.

BRIEF DESCRIPTION

DETAILED DESCRIPTION OF THE DRAWINGS

Figure 1:
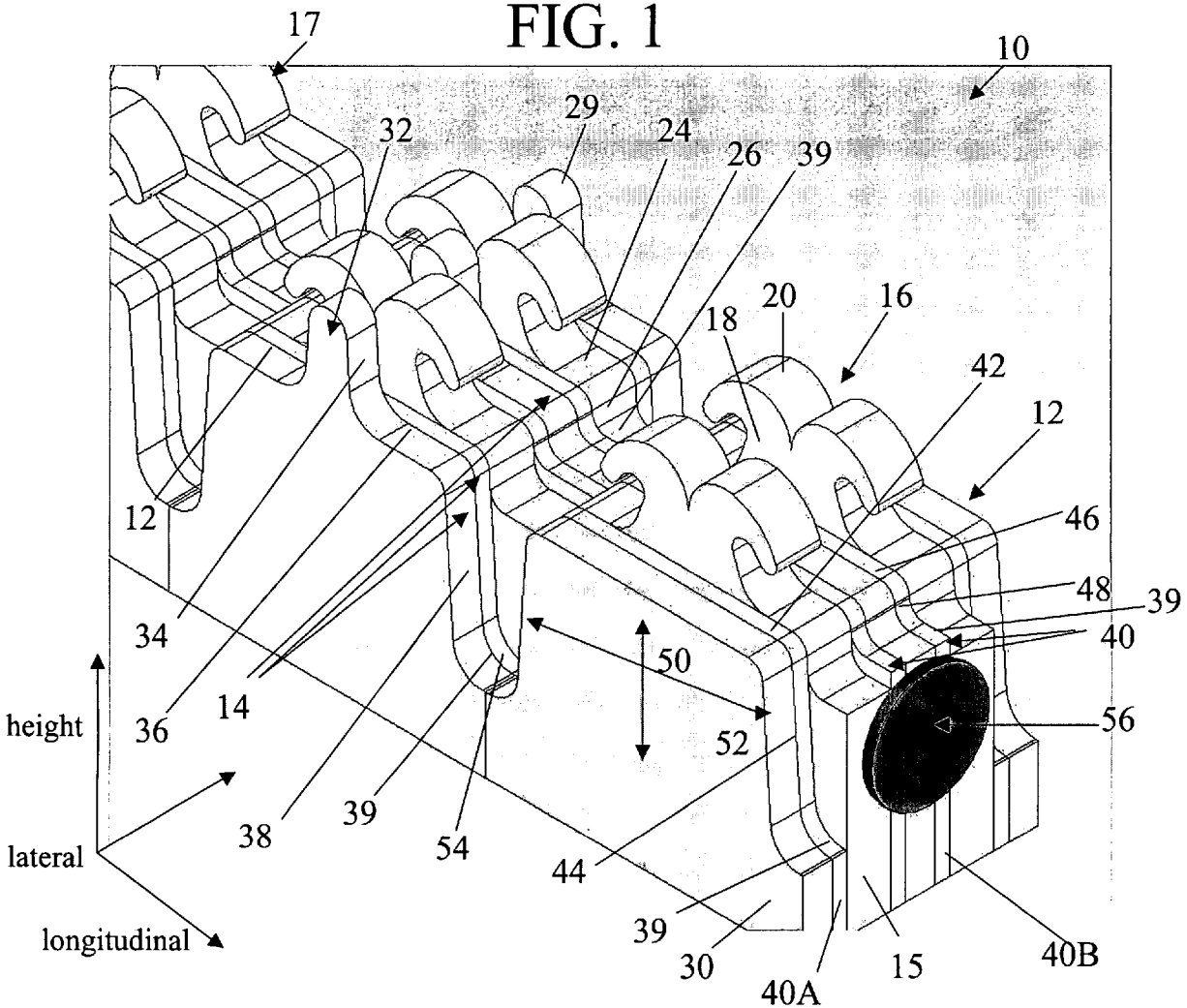
FIG. 1 shows a perspective view of a portion of a hook fastener structure according to one embodiment of this invention.

FIG. 1 illustrates a schematic perspective view of a preferred embodiment of a fastener structure 10 according to the present invention. Structure 10 according to this drawing can be considered to be formed of a plurality of layers 14, each of which can correspond to a die in a conventional ring mold in which structures according to the present invention can be (but need not be) formed. Each die can be specially cut to correspond to specific shapes in the layers 14 shown in FIG. 1, and then built up to form a cylinder which may be placed in the mold and used as the "negative image" or die from which the structure is formed. According to such processes, suitable plastic material is applied at a first position as the cylindrical die rotates, and can be apportioned and urged into the cavities of the mold using a spreader. As the die continues to rotate, the plastic material cools and is drawn off at a second position in a continuing process as the die continues to rotate in order to receive more material for additional lengths of structures 10. Structures 10 may be formed using any of a variety of engineering plastics known to those practicing in this art, including polyamides, polyurethanes and polyesters. Preferably, a formulation of polybutylene terephthalate ("PBT"), supplied by Toray Resin Company, Troy, Mich., USA.

The vertical axis of FIG. 1 corresponds to the "height" of relevant features of structure 10 relative to each other and absolutely, while the longitudinal direction of structure 10 proceeds diagonally across the page along the length of structure 10 generally corresponding to the direction in which the layers 14 extend. The lateral direction is orthogonal or at right angles to both the height direction and longitudinal direction, and thus extends diagonally up the page on which FIG. 1 is placed. The height, longitudinal and lateral coordinate axes are shown on FIG. 1.

The particular structure 10 shown in FIG. 1 contains three broad categories of layers 14, although fewer or more categories of layers may be used: hook layer 15; retention layer 30 and spacer layer 40. These layers, as disclosed above in connection with the molding process, may actually be formed integrally to each other as in a conventional ring-mold process or any other desired technique, or they may be formed non-integrally as by, for example, being formed separately and then bonded together.

Hook layer 15 generally comprises a plurality of hooks 16, each of which features a stem 18 and a crook portion 20 (which may resemble a palm-tree, the letter "j", or any other desired shape). Each hook extends or projects from a base 12.

Each base 12 of the hook layer 15 preferably includes a hook layer base top surface 24 disposed adjacent the stem 18 of a particular hook 16. The hook layer base top surface 24 transitions in direction so that a hook layer base side surface 26 is formed, generally extending in the height direction as shown in FIG. 1. Preferably, but not necessarily, the hook layer base top surface 24 extends in a longitudinal direction on either side of the intersection of the hook 16 with the base 12 for a distance greater than the hook layer base side surface 26 extends in a height direction. The hook layer base side surfaces 26 of successive bases 12 form a valley 39 between bases 12. All of valleys 39 in successive layers may be of the same or different heights, or valleys may differ in height from one layer category to the next, or some categories to the next. In the embodiment shown in FIG. 1, the valleys 39 between bases 12 are shallower in height than valleys 39 of some layers, but deeper in height than other layers, although this need not necessarily be the case. Additionally, in the embodiment shown in FIG. 1, the valleys 39 in some retention layers 30 (discussed below) are different in height than valleys in other retention layers 30, and the valleys 39 in some spacer layers 40 (discussed below) are different in height than valleys in other spacer layers 40, though again, this need not be the case.

Bases 12 of hook layers 15 complement bases 12 of other layers as they extend laterally across structure 10 as shown in FIG. 1 to support a row 17 of hooks 16 extending laterally across the structure 10. Accordingly, bases 12 of various layers 14 preferably feature substantially the same longitudinal length 52, at least along the top surfaces, although the lengths of such top surfaces of bases 12 in various layers 14 can differ if desired. In structure 10 as shown in FIG. 1, they are the same, to provide rows of plateau-shaped structures, comprising the top surfaces of bases 12. At least some portion of the bases 12 are preferably but need not necessarily be horizontal (orthogonal to the height direction) and substantially planar, extending in a direction longitudinal from the intersection of hooks 16 and bases 12. Such a structure provides a strong and stable base 12 from which stems 18 of hooks 16 can extend to provide robust structures supporting crooks 20. Yet valleys 39 allow bases 12 to extend into the loop or other engaging material so that crooks 20 can engage the material and cause fastening to occur. The strength and stability afforded by bases 12 combined with the robustness of the stems 18 and, as desired, the crooks 20, allow permanent or semi-permanent fastening to occur such as desired for signage and automotive seat cover or installation applications.

In automotive seat cover installation applications and other applications, it is customary to seat or mold structures 10 into a plastic foam material which can surround the sides of structure 10 when the foam is flowing and before it sets. Accordingly, the structure 10 features walls (not shown) along its sides extending longitudinally down the length of structure 10 and preferably as great in height as the height of hooks 16. Such walls may be formed using layers in a conventional ring-molding process as are other layers 14. There may be any number of hook layers 15 and other layers 14 extending laterally across the structures 10, which layers are ultimately bounded on either side by the walls (not shown). However, the walls along the sides of structure 10 do not address foam which may flow or intrude at the ends of structure 10 between hooks 16 in a row 17.

Accordingly, structure 10 preferably includes retention layers 30 which have bases 12 from which fingers 32 project in some rows 29 of bases 12 to be interposed between hooks 16. Preferably, fingers 32 extend in height substantially equal to the height of hooks 16 and are aligned with hooks 16 generally laterally so as to extend between hooks 16 and form barriers to preclude or impede foam or other material from flowing between hooks 16. Preferably, but not necessarily, there are gaps between fingers 32 and hooks 16 formed by spacer layers 40 as discussed below. However, in structures 10 where fingers 32 connect with hooks 16, the fingers 32 may provide lateral stability and strength to hooks 16. In that vein, particularly in structures where spacer layers 40 are not used, widths of laterally of layers 14 may differ, so that, for instance, retention layers 30 may have greater width in the lateral direction as shown in FIG. 1 than hook layers 15.

Not all bases 12 in retention layer 30 need support fingers 32. In a preferred embodiment, for example, every sixth hook row 17 also features fingers 32, so that every sixth row of hooks 16 has a barrier formed by fingers 32. Other periodicity may be selected as desired, or the placement of fingers 32 on bases 12 of retention layer 30 need not be periodic. Alternatively, fingers 32 may be omitted, so that retention layer 30 resembles or constitutes a spacer layer 40 (discussed below) to interpose gaps between hooks 16 in a hook row 17. It has been found that every sixth row of hooks 16 with a barrier of fingers 32 is suitable in applications where various lengths of structures 10 are used, and thus where it cannot be precisely predicted where structures 10 need to be cut to restrict flow of foam material into a substantial portion of structures 10 during mold-in procedures.

Preferably similar to the bases 12 of hook layers 15, retention layers 30 have bases 12 which feature a retention layer base top surface 36 which transitions to a retention layer base side surface 38 to form valleys 39. In the embodiment shown in FIG. 1, some retention layers 30 have deeper valleys 39 and some have shallower valleys 39. Height of valleys 39 in successive layers can be adjusted and optimized to suit particular structural strength, rigidity, and fastening strength parameters, among others, for particular installations and applications. Width of valleys 39 in the longitudinal direction can also be adjusted as desired for similar or different purposes and for particular applications.

Some embodiments of the present invention, such as the structure 10 shown in FIG. 1, include spacer layers 40 which are primarily adapted to be interposed between hook layers 15 and retention layers 30 in order, among other things, to allow adjustment of spacing between hooks 16, provide gaps between hooks 16 and fingers 32, allow width of structure 10 to be adjusted as desired, and for other purposes as desired. In structures where the retention layers 30 are deemed necessary or used, spacer layers 40 can be considered conceptually and in practice to constitute retention layers 30 without fingers 32, and having any width as desired so as for instance to separate hooks 16 within a row 17 at a desired distance laterally. Accordingly, a spacer layer 40 can be considered conceptually to constitute or resemble a hook layer 15 without hooks 16 or a retention layer 30 without fingers 32. Thus, structures 10 may be formed according to embodiments of the invention in which hook layers 15 are separated by spacer layers 40 without retention layers 30, such as, for example for applications where barriers or fingers 32 may not needed such as in some signage applications.

In the embodiment shown in FIG. 1, first spacer layers 40A feature deeper valleys 39 than second spacer layers 40B where the valleys act more like ribs within a row of valleys 39 extending laterally across the structure 10. In both cases, spacer layers 40 have a top surface and preferably a side surface. Spacer layer 40A has valley spacer layer base top surface 42 which transitions to valley spacer layer base side surface 44 to form deeper valley 39, while spacer layer 40B has rib spacer layer base top surface 46 which transitions into rib spacer layer base side surface 48 to form shallower valleys or ribs 39.

The particular structure 10 shown in FIG. 1 includes at least one, and preferably multiple, longitudinal members 56 which may have strength and/or magnetic properties as desired. Such members 56 are disclosed in above-referenced U.S. Ser. No. 11/043,339 filed Jan. 26, 2005 in the name of Akeno, et. al, published as U.S Pub. No. 2005/0160534 A1 on Jul. 28, 1995, which is incorporated herein by reference. Such members 56 are preferably formed of nylon and iron material, and most preferably constitute a product known as iron monofilament supplied by C.I. Kasei, Company, Ltd. of Tokyo, Japan. Such structures 56 may be molded into structures 10 during the molding process.

FIG. 1 shows base 12 of spacer layer 40A of that particular embodiment having a height 50 which is less than the width 52 of the base 12 in the longitudinal direction, and more particularly, the length or dimension of the top surface of base 12 of that layer in the longitudinal direction, although this particular dimensional constraint is not necessary. For this purpose, height 50 is considered to be the height of valley 39 from valley floor 54 as shown in FIG. 1 to top surface 42 of layer 40A.

Figure 2:
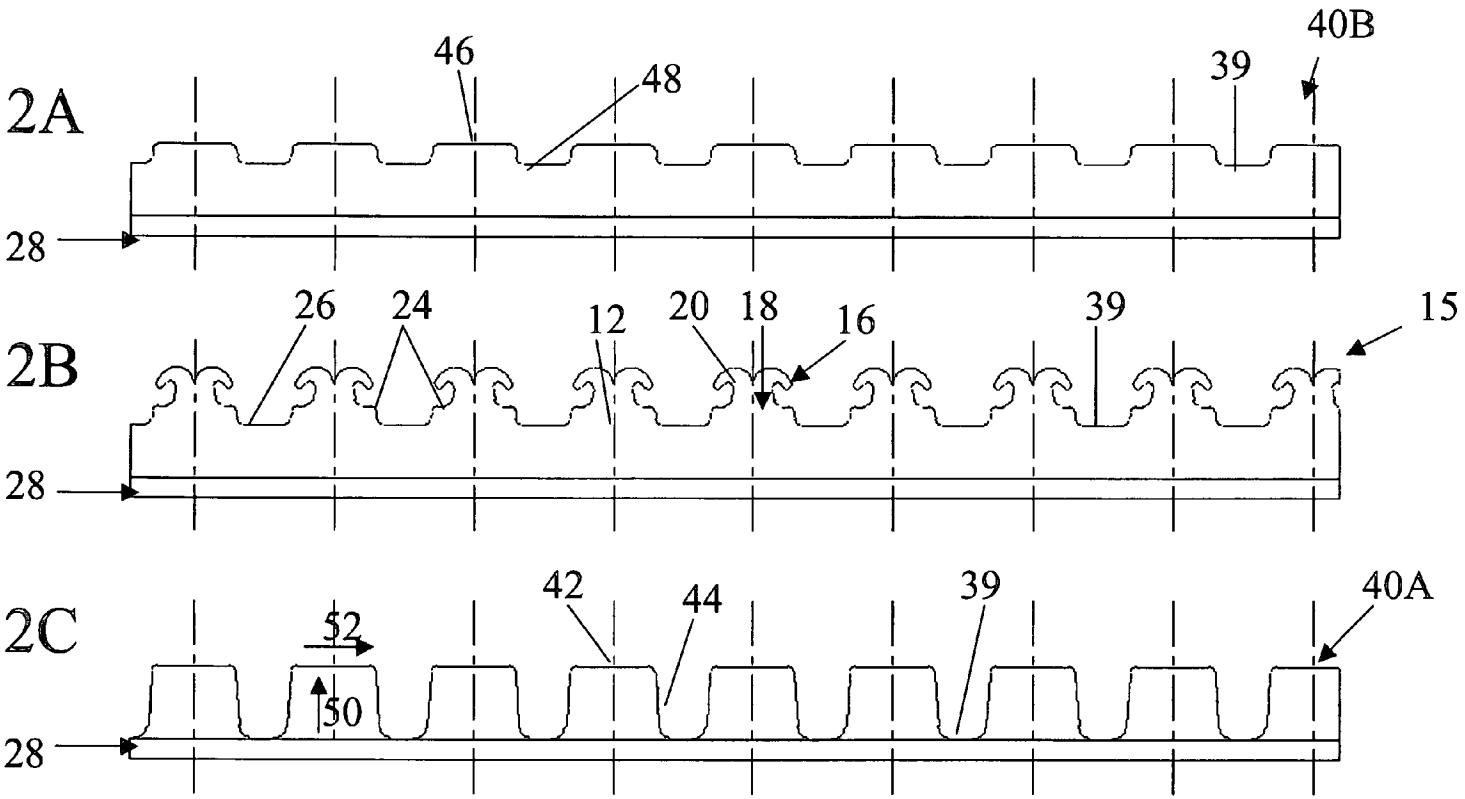
FIG. 2 shows side views of the layers that form the hook fastener structure of FIG. 1.
Figure 2:
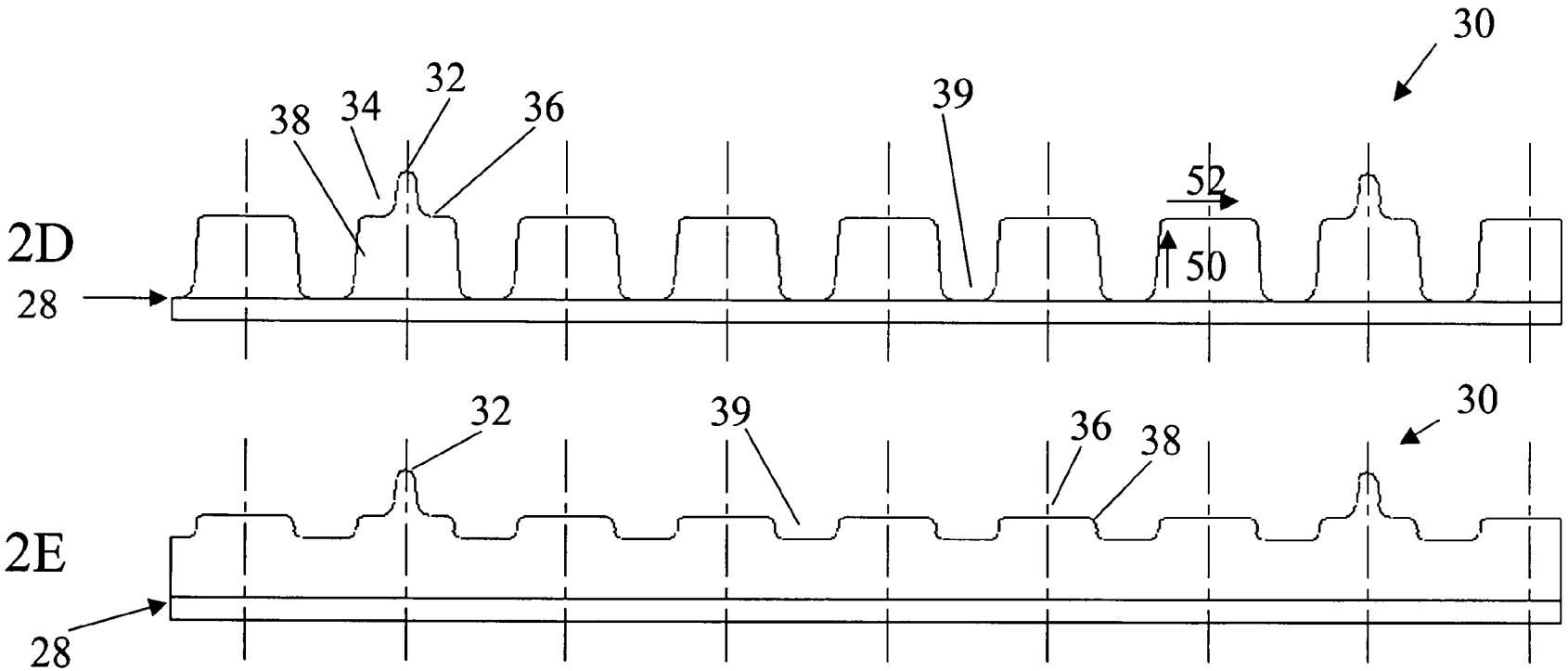

FIG. 2 shows, for the particular embodiment of FIG. 1, successive layers in which the valley height 50 is about 1.1 mm, the width of the top surface of bases 12 is about 1.3 mm, and the height of the hooks 16 above the base is about 0.8 mm. In the embodiment shown in FIG. 1, each hook row 17 includes 10 hooks across, and distance between centerlines of hooks 16 in a longitudinal direction is about 3.5 mm while distance between hook centerlines in a lateral direction is about 0.7 mm. Other dimensions and configurations may be adopted and used.

Side surfaces 26, 38, 44 and 48 of the embodiment shown in FIG. 1 are angled at about 8 degrees from the height direction. Similarly, the sides of hook stems 18 of that embodiment facing in the longitudinal direction are angled at about 20 degrees. These sides may instead extend substantially in the height direction (substantially vertical), or may be angled less or more than about 20 degrees. Sides of stems 18, hooks 16, crooks 20, and fingers 32 facing in a lateral direction may also be also be angled or not angled from the height direction as desired, with or without any suitable curvature as a matter of design choice.

Figure 3:
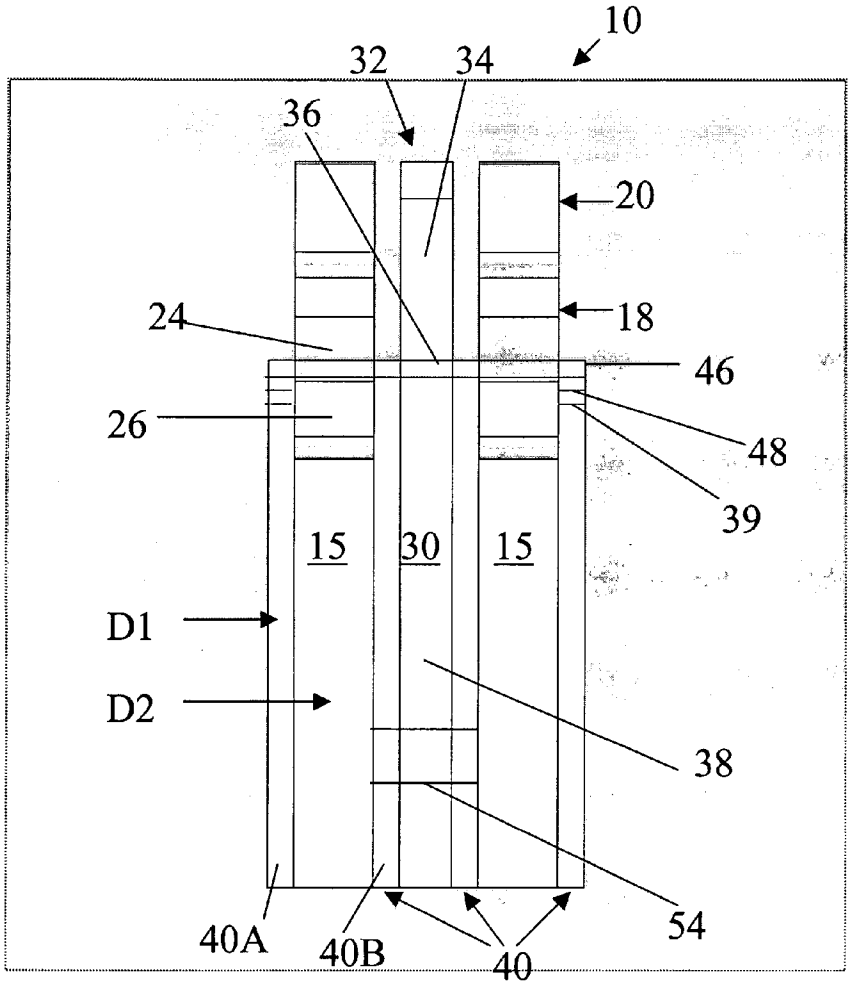
FIG. 3 shows a lateral cross-sectional view of a part of the hook fastener structure of FIG. 1, across a section having a stem and a finger that coincide with one another.
Figure 4:
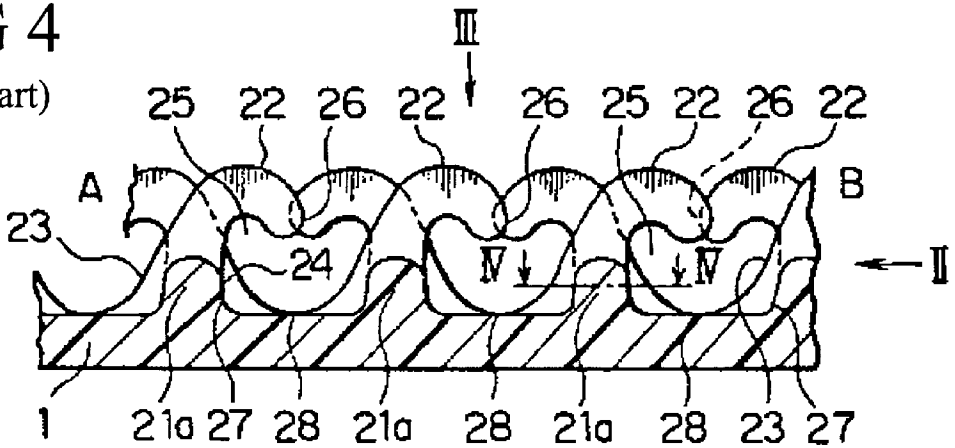
FIG 4 (prior art)
FIG. 4 shows an example of prior art hook elements.
Figure 5:
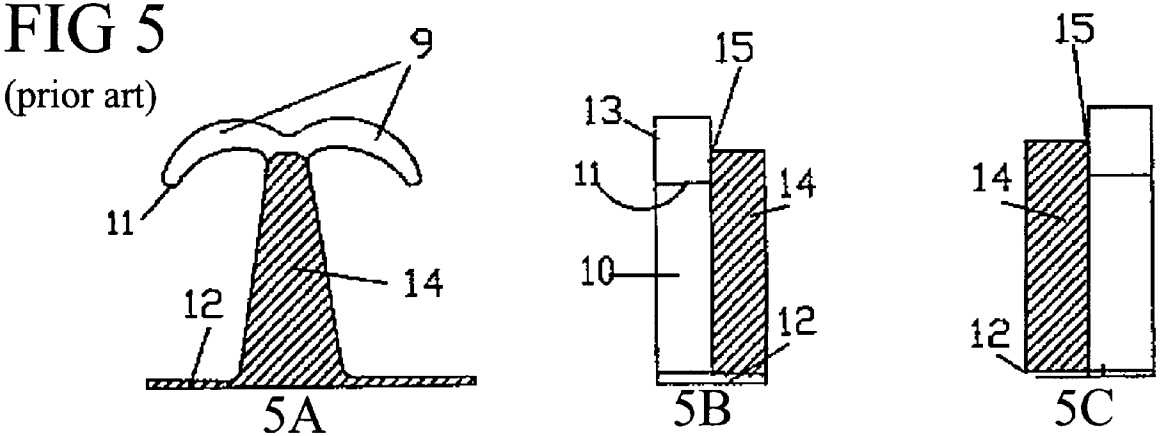
FIG 5 (prior art)
FIG. 5 shows another example of prior art hook elements.

FIG. 3 shows a lateral cross section of structure 10 with various parts of hook layers 15, retention layers 30, and spacer layers 40 of the particular structure shown in FIG. 1.

FIG. 2 accentuates the idea that unlike previous hook and loop fasteners, structures 10 according to the present invention can be considered to have hooks 16 which extend from bases 12 that project in height above a foundation level 28, as compared to earlier structures where the stems 18 of hooks 16 project from the foundations 28. Again, such bases 12 add strength and other desirable properties not only to structure 10 as a whole, but also to hooks 16 for purposes of allowing effective engagement by crooks 20 into loop material or other engagement members for permanent or semi-permanent fastening.

Figure 6:
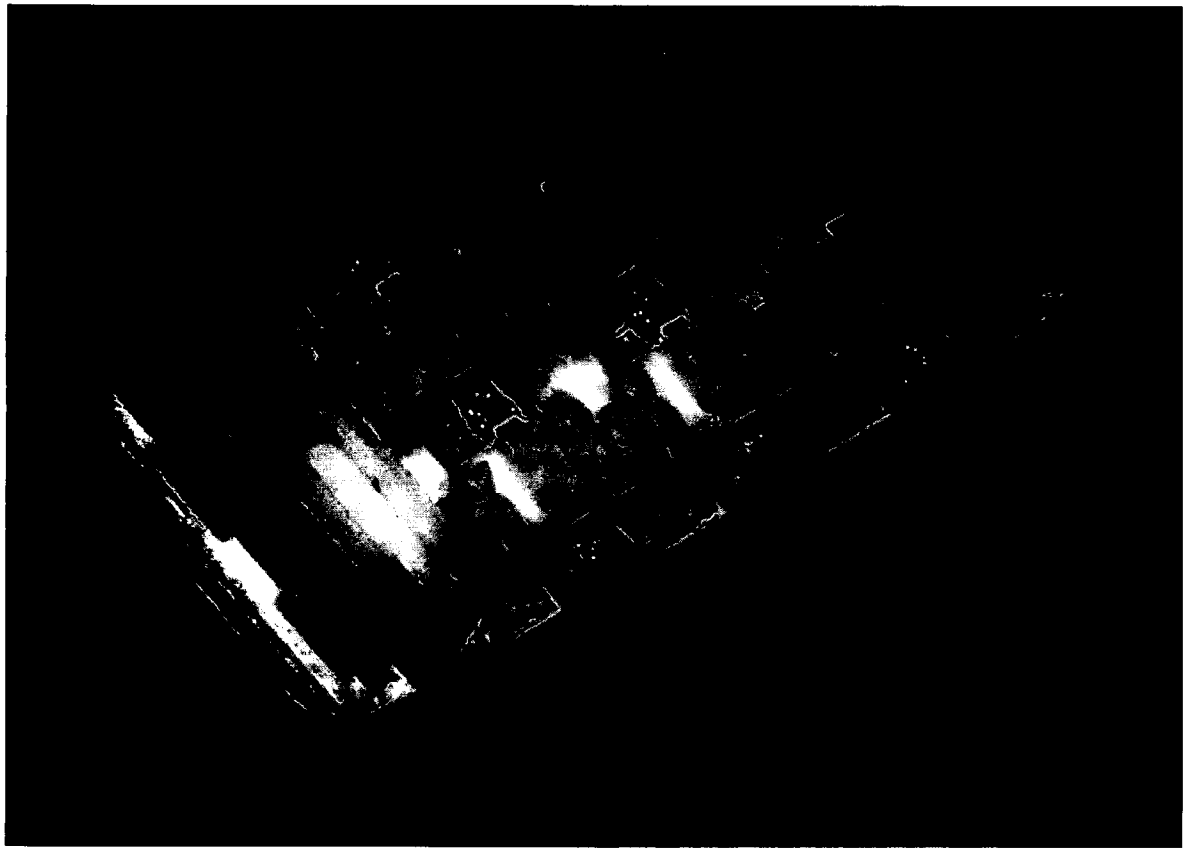
FIG. 6 is a perspective view photomicrograph of a portion of a hook fastener structure formed according to the present invention.

FIG. 6 is a photomicrograph showing in perspective a length of fastener 10 formed according to one embodiment of the present invention.

Hook fastener structures according to the present invention can be manufactured and/or adapted to engage with various types of loop or engagement material, including woven or knit loop materials. In certain automotive seat covering applications, for example, a product used with hook fastener materials by General Motors known as Tiger Thread may be used.

According to one embodiment of the invention, a length of structure 10 as shown in FIG. 1, featuring hook rows 17 with 10 hooks per row and retention rows 29 every 6 rows, and also with the dimensions recited above, was formed using a conventional continuous mold process consistent with the disclosure of above-referenced U.S. Ser. No. 11/043,339 filed Jan. 26, 2005 in the name of Akeno, et. al, published as U.S Pub. No. 2005/0160534 A1 on Jul. 28, 1995, which is incorporated herein by reference. The polybutylene terephthalate product identified above was continuously injected at a temperature of 300 degrees Centigrade to the peripheral surface of a die wheel having an outer diameter of 250 mm, rotating at a rate of 5 cycles per minute. Three lengths of material 56, comprising the product identified above, were introduced into molding position corresponding to grooves on the die wheel from the upstream side of the die wheel in the rotation direction of the die wheel relative to an injection position of the polybutylene terephthalate product. Linear takeoff speed of the structure 10 from the die wheel was at a rate of 4 meters per minute. The structure 10 so formed complied with General Motors Engineering Standard GM2743M entitled "Recloseable Fasteners" dated December 1997 bearing a copyright date of Mar. 8, 2001.

Other structures, dimensions and arrangements may be made in addition to the particular embodiment shown in FIGS. 1-3, such as inclusion or exclusion of various layers 14 as well as dimensions of various components of those layers, to achieve the objective of providing structures according to the present invention which are effective as hook fasteners for engagement with loop or other engagement material to form a permanent or semi-permanent fastening structure.

The invention claimed is:

1. A fastener structure, comprising:

a plurality of hook layers, each hook layer:

extending in a generally longitudinal direction in the structure;

including a plurality of hooks, each hook extending from a hook layer base;

wherein the hook layer bases are separated from each other by valleys;

a plurality of retention layers, each retention layer:

extending in a generally longitudinal direction in the structure;

including a plurality of fingers, each finger extending from a retention layer base;

including a plurality of retention layer bases from which no finger extends;

wherein the retention layer bases are separated from each other by valleys;

a plurality of spacer layers, each spacer layer:

including a plurality of spacer layer bases;

wherein the spacer layer bases are separated from each other by valleys;

wherein:

each hook layer base, retention layer base and spacer layer base includes a top surface;

the top surfaces of at least some of the hook layer bases, retention layer bases, and spacer layer bases together form an essentially horizontal surface; and the hook layers, retention layers and spacer layers are arranged to provide a plurality of hook rows extending in a generally lateral direction across the fastener structure, some of which hook rows include fingers.

2. A fastener structure according to claim 1 in which the layers are formed integrally to each other.

3. A fastener structure according to claim 1 in which hook rows that include fingers occur periodically among hook rows in a longitudinal direction along the fastener.

4. A fastener structure according to claim 1 in which valleys in the hook layers, retention layers and spacer layers are substantially the same height.

5. A fastener structure according to claim 1 in which at least some valleys in hook layers differ in height from at least some valleys in at least some retention layers.

6. A fastener structure according to claim 1 in which at least some valleys in hook layers differ in height from at least some valleys in retention layers and spacer layers, and at least some valleys in retention layers and spacer layers differ in height from valleys in other retention layers and spacer layers.

7. A fastener structure according to claim 1 wherein the hook layer bases include a top surface and a side surface, the top surface including a dimension in the longitudinal direction in the fastener which exceeds the height of the side surface.

8. A fastener structure according to claim 1 wherein the bases of the retention layers include a longitudinal dimension that exceeds the height of valleys separating the bases.

9. A fastener structure according to claim 1 further comprising a plurality of tensile strength members extending generally longitudinally in the fastener structure.

10. A fastener structure according to claim 1 further comprising engagement material with which the structure is adapted to engage.

11. A fastener structure according to claim 1 further comprising at least one longitudinal member having tensile strength and magnetic properties.

12. A fastener structure, comprising:

a plurality of hook layers, each hook layer:

extending in a generally longitudinal direction in the structure;

including a plurality of hooks, each hook extending from a hook layer base;

wherein the hook layer bases are separated from each other by valleys;

a plurality of retention layers, each retention layer:

extending in a generally longitudinal direction in the structure;

including a plurality of fingers, each finger extending from a retention layer base;

including a plurality of retention layer bases from which no finger extends; and wherein the retention layer bases are separated from each other by valleys;

wherein:

each hook layer base and retention layer base includes a top surface;

the top surfaces of at least some of the hook layer bases and retention layer bases are positioned at essentially the same height to form an essentially flush surface; and the hook layers and retention layers are arranged to provide a plurality of hook rows extending in a generally lateral direction across the fastener structure, some of which hook rows include fingers located between hooks and some of which hook rows do not include fingers located between hooks.

13. A fastener structure according to claim 12 further comprising a plurality of spacer layers disposed between hook layers and retention layers to preclude hooks from contacting fingers.

14. A fastener structure according to claim 12 in which at least some of the hooks are connected to at least some of the fingers.

15. A fastener structure according to claim 12 in which at least some of the hooks are generally palm-tree shaped.

16. A fastener structure according to claim 12 in which at least some of the hooks are generally j-shaped.

17. A fastener structure according to claim 12 in which the layers are formed integrally to each other.

18. A fastener structure according to claim 12 wherein the hook layer bases include an essentially horizontal top surface and a side surface, the top surface including a dimension in the longitudinal direction in the fastener which exceeds the height of the side surface.

19. A fastener structure according to claim 12 wherein the bases of the retention layers include a longitudinal dimension that exceeds the height of valleys separating the bases.

20. A fastener structure according to claim 12 further comprising a plurality of tensile strength members extending generally longitudinally in the fastener structure.

21. A fastener structure according to claim 12 in which the layers are formed integrally to each other.

22. A fastener structure according to claim 12 further comprising a separate member adapted to engage the hooks of the hook layers, whereby the separate member is capable of being physically separated from the hooks of the hook layers.

23. A fastener structure according to claim 12 further comprising engagement material with which the structure is adapted to engage.

24. A fastener structure according to claim 12 further comprising at least one longitudinal member having tensile strength and magnetic properties.

25. A fastener structure adapted to be engaged with engaging material to form a fastener, the structure comprising:

a plurality of bases which extend laterally across at least a portion of the structure to form rows of bases, each row projecting in a height dimension from a bottom portion of the structure;

a plurality of hooks extending in a height direction from at least some of the base rows to form rows of hooks, the hooks adapted to penetrate into and engage with the engaging material;

a plurality of fingers which extend in a height direction from base rows wherein the fingers are interposed laterally between hooks in at least some rows of hooks;

a plurality of valleys, each valley extending laterally across at least a portion of the structure and interposed between two base rows in order at least partially to separate base rows from each other;

wherein each base row contains a top surface portion extending in a longitudinal direction from the intersection of the hooks with the base; and wherein each base row does not change substantially in cross sectional shape as it extends laterally in the structure.

26. A fastener structure according to claim 25 wherein the hook shapes resemble palm trees.

27. A fastener structure according to claim 25 wherein the fingers do not contact the hooks.

28. A fastener structure according to claim 25 wherein the fingers contact the hooks.

29. A fastener structure according to claim 25 wherein the structure is formed using a ring mold, and the hooks correspond to indentations in rings of the mold die.

30. A fastener structure according to claim 25 further comprising engaging material adapted to be engaged by the fastener structure to form a fastener.

31. A fastener structure according to claim 25 further comprising at least one longitudinal member having tensile strength and magnetic properties.

* * * * *

UNITED STATES PATENT AND TRADEMARK OFFICE

CERTIFICATE OF CORRECTION

PATENT NO. : 7,493,676 C1
APPLICATION NO. : 90/010502
DATED : July 6, 2010
INVENTOR(S) : Ryuichi Murasaki et al.

It is certified that error appears in the above-identified patent and that said Letters Patent is hereby corrected as shown below:

On the Title page, in Item (56), under "Foreign Patent Documents", in column 2, line 2, delete "12/1802" and insert -- 12/2002 --, therefor.

On Title page 2, in column 2, under "U.S. Patent Documents", line 9, delete "2004/0194263" and insert -- 2004/0194262 --, therefor.

Signed and Sealed this
Twenty-ninth Day of March, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,493,676 B2
APPLICATION NO. : 11/403532
DATED : February 24, 2009
INVENTOR(S) : Ryuichi Murasaki et al.

It is certified that error appears in the above-identified patent and that said Letters Patent is hereby corrected as shown below:

In column 7, line 25, delete “Recloseable” and insert -- Reclosable --, therefor.

Signed and Sealed this
Fifth Day of April, 2011

David J. Kappos

David J. Kappos
*Director of the United States Patent and Trademark Office*

US007493676C1

(12) EX PARTE REEXAMINATION CERTIFICATE (7595th)

United States Patent
Murasaki et al.

(10) Number: US 7,493,676 C1
(45) Certificate Issued: Jul. 6, 2010

(54) HOOK FASTENER STRUCTURES

(75) Inventors: Ryuichi Murasaki, Macon, GA (US); Tsuyoshi Minato, Cheshire (GB)

(73) Assignee: YKK Corporation, Tokyo (JP)

Reexamination Request:
No. 90/010,502, Aug. 7, 2009

Reexamination Certificate for:

| | |
|---|---|
| Patent No.: | **7,493,676** |
| Issued: | **Feb. 24, 2009** |
| Appl. No.: | **11/403,532** |
| Filed: | **Apr. 13, 2006** |

(51) Int. Cl.
*A44B 18/00* (2006.01)

(52) U.S. Cl. ..... 24/442; 24/452; 428/100

(58) Field of Classification Search ..... None
See application file for complete search history.

(56) References Cited

U.S. PATENT DOCUMENTS

| | | | |
|---|---|---|---|
| 3,557,407 | A | 1/1971 | Lemelson |
| 4,189,809 | A | 2/1980 | Sotos |
| 4,794,028 | A | 12/1988 | Fischer |
| 4,872,243 | A | 10/1989 | Fischer |
| 4,984,339 | A | 1/1991 | Provost et al. |
| 5,067,210 | A | 11/1991 | Keyaki |
| 5,116,563 | A | 5/1992 | Thomas et al. |
| 5,131,119 | A | 7/1992 | Murasaki et al. |
| 5,144,786 | A | 9/1992 | Pacione |
| 5,180,534 | A | 1/1993 | Thomas et al. |
| 5,230,851 | A | 7/1993 | Thomas |
| 5,235,731 | A | 8/1993 | Anzai et al. |
| 5,315,740 | A | 5/1994 | Provost |
| 5,318,741 | A | 6/1994 | Thomas |
| 5,325,569 | A | 7/1994 | Goulait et al. |

(Continued)

FOREIGN PATENT DOCUMENTS

| | | |
|---|---|---|
| CA | 2160057 | 1/1999 |
| EP | 1265507 | 12/1802 |
| EP | 0421295 | 2/1994 |
| EP | 0381087 | 3/1994 |
| EP | 0464753 | 10/1994 |
| EP | 0464754 | 11/1994 |
| EP | 0567103 | 7/1997 |
| EP | 0891724 | 1/1999 |
| EP | 0641528 | 10/1999 |
| EP | 0714614 | 3/2000 |

(Continued)

OTHER PUBLICATIONS

General Motors Engineering Standard GM2743M entitled "Reclosable Fasteners", Dec. 1997, pp. 1–6.

*Primary Examiner*—Peter C. English

(57) ABSTRACT

Hook structures for use in hook and loop or hook and engagement material fastening applications. Structures according to embodiments of the invention include hooks which extend from bases which in turn extend from a foundation and also extend laterally across the structures. The bases are separated by valleys which also extend laterally across the structures, whose height can be uniform laterally in the structures or varied. The bases provide suitable strength and support to allow the hooks to be robust and strong for permanent or semi-permanent fastening applications, while the valleys interposed between bases allow the hooks to penetrate sufficiently deeply into the engagement material for effective fastening to occur. Such structures may be formed according to processes which physically or conceptually employ various layers to support hooks, retention barrier members such as fingers interposed laterally between hooks, and/or for spacing such hooks and barriers as desired. Accordingly, structures can be formed according to the present invention using conventional ring-molding techniques (or any other desired techniques), to provide hook fasteners with excellent fastening strength and other desired properties typically required, for example, in semi-permanent or permanent fastening applications.

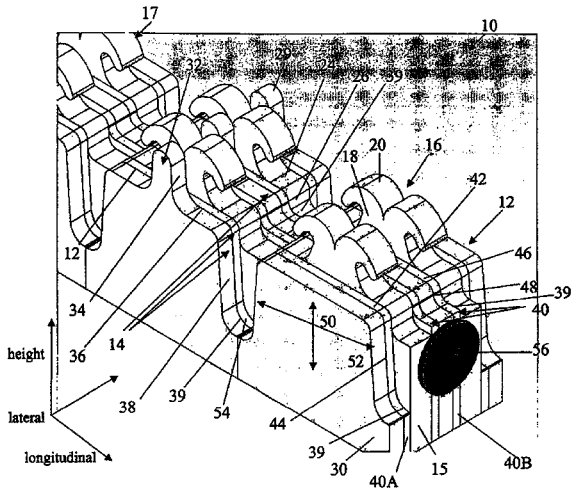

U.S. PATENT DOCUMENTS

| | | | | | |
|---|---|---|---|---|---|
| 5,339,499 | A | * | 8/1994 | Kennedy et al. | 24/452 |
| 5,385,706 | A | | 1/1995 | Thomas | |
| 5,392,498 | A | | 2/1995 | Goulait et al. | |
| 5,540,673 | A | | 7/1996 | Thomas et al. | |
| 5,551,130 | A | | 9/1996 | Tominaga et al. | |
| 5,604,963 | A | | 2/1997 | Akeno | |
| 5,620,769 | A | | 4/1997 | Wessels et al. | |
| 5,625,930 | A | | 5/1997 | Takizawa et al. | |
| 5,657,517 | A | | 8/1997 | Akeno et al. | |
| 5,685,050 | A | | 11/1997 | Murasaki | |
| 5,692,271 | A | | 12/1997 | Provost et al. | |
| 5,702,797 | A | | 12/1997 | Sakakibara et al. | |
| 5,715,581 | A | * | 2/1998 | Akeno | 24/452 |
| 5,720,740 | A | | 2/1998 | Thomas | |
| 5,781,969 | A | | 7/1998 | Akeno et al. | |
| 5,839,172 | A | | 11/1998 | Takizawa et al. | |
| 5,857,527 | A | | 1/1999 | van Vuuren | |
| 5,884,374 | A | | 3/1999 | Clune | |
| 5,887,320 | A | | 3/1999 | Provost | |
| 5,900,350 | A | | 5/1999 | Provost et al. | |
| 6,063,067 | A | | 5/2000 | Takizawa et al. | |
| 6,131,251 | A | | 10/2000 | Provost | |
| 6,163,939 | A | | 12/2000 | Lacey et al. | |
| 6,224,807 | B1 | | 5/2001 | Clune | |
| 6,671,935 | B2 | | 1/2004 | Filion et al. | |
| D516,952 | S | | 3/2006 | Kingsford et al. | |
| 7,516,524 | B2 | * | 4/2009 | Provost et al. | 24/452 |
| 2001/0052170 | A1 | | 12/2001 | Aamodt et al. | |
| 2003/0121128 | A1 | | 7/2003 | Vanbenschoten et al. | |
| 2004/0194263 | A1 | | 10/2004 | Kurtz et al. | |
| 2005/0160534 | A1 | * | 7/2005 | Akeno et al. | 24/452 |

FOREIGN PATENT DOCUMENTS

| | | |
|---|---|---|
| EP | 0711518 | 9/2001 |
| EP | 0709038 | 3/2002 |
| EP | 0811331 | 1/2003 |
| EP | 1700532 | 9/2006 |
| GB | 1372536 | 10/1974 |
| JP | 519943 | 1/1976 |
| WO | WO-1994022338 | 10/1994 |
| WO | WO-1999060881 | 12/1999 |

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-11 is confirmed.

Claims 13 and 27 are cancelled.

Claims 12 and 25 are determined to be patentable as amended.

Claims 14-24, 26 and 28-31, dependent on an amended claim, are determined to be patentable.

12. A fastener structure, comprising:

a plurality of hook layers, each hook layer:

extending in a generally longitudinal direction in the structure;

including a plurality of hooks, each hook extending from a hook layer base;

wherein the hook layer bases are separated from each other by valleys;

a plurality of retention layers, each retention layer:

extending in a generally longitudinal direction in the structure;

including a plurality of fingers, each finger extending from a retention layer base;

including a plurality of retention layer bases from which no finger extends; and wherein the retention layer bases are separated from each other by valleys; *and*

*a plurality of spacer layers disposed between hook layers and retention layers to preclude hooks from contacting fingers;* wherein:

each hook layer base and retention layer base includes a top surface;

the top surfaces of at least some of the hook layer bases and retention layer bases are positioned at essentially the same height to form an essentially flush surface; and the hook layers and retention layers are arranged to provide a plurality of hook rows extending in a generally lateral direction across the fastener structure, some of which hook rows include fingers located between hooks and some of which hook rows do not include fingers located between hooks.

25. A fastener structure adapted to be engaged with engaging material to form a fastener, the structure comprising:

a plurality of bases which extend laterally across at least a portion of the structure to form rows of bases, each row projecting in a height dimension from a bottom portion of the structure;

a plurality of hooks extending in a height direction from at least some of the base rows to form rows of hooks, the hooks adapted to penetrate into and engage with the engaging material;

a plurality of fingers which extend in a height direction from base rows wherein the fingers are interposed laterally between hooks in at least some rows of hooks;

a plurality of valleys, each valley extending laterally across at least a portion of the structure and interposed between two base rows in order at least partially to separate base rows from each other;

*wherein the fingers do not contact the hooks;* wherein each base row contains a top surface portion extending in a longitudinal direction from the intersection of the hooks with the base; and wherein each base row does not change substantially in cross sectional shape as it extends laterally in the structure.

* * * * *